US006688649B2

(12) United States Patent
Casagrande

(10) Patent No.: US 6,688,649 B2
(45) Date of Patent: Feb. 10, 2004

(54) FORM WITH INTEGRATED LABEL OR FOLD-OVER CARD INTERMEDIATE AND PHOTOGRAPH WELL

(75) Inventor: Charles L. Casagrande, Bradenton, FL (US)

(73) Assignee: Strata-Tac, Inc., Batavia, IL (US)

( * ) Notice: Subject to any disclaimer, the term of this patent is extended or adjusted under 35 U.S.C. 154(b) by 28 days.

(21) Appl. No.: 09/949,401

(22) Filed: Sep. 7, 2001

(65) Prior Publication Data

US 2002/0084649 A1 Jul. 4, 2002

Related U.S. Application Data

(63) Continuation-in-part of application No. 09/318,353, filed on May 25, 1999.

(51) Int. Cl.[7] ..... B42D 15/00

(52) U.S. Cl. ..... 283/61; 283/18; 283/21; 283/62; 283/75; 283/101; 283/105; 283/106; 283/109; 206/449; 206/455; 206/460; 206/461; 206/484; 206/486; 206/488; 206/489; 428/40.1; 428/41.7; 428/41.8; 428/41.9; 428/42.2; 428/42.3; 428/43; 428/192; 428/194; 428/201; 40/768; 40/769; 40/772; 40/773

(58) Field of Search ..... 428/43, 201, 192, 428/194, 40.1, 41.7, 41.8, 41.9, 42.2, 42.3; 206/449, 455, 460, 461, 484, 486, 488, 489; 283/18, 21, 61, 62, 75, 105, 106, 109; 40/768, 769, 772, 773

(56) References Cited

U.S. PATENT DOCUMENTS

| | | | | |
|---|---|---|---|---|
| 2,213,666 A | 9/1940 | Burke | | |
| 2,255,019 A | 9/1941 | Wolters et al. | ..... | 156/268 |
| 2,896,351 A | 7/1959 | Johnson | ..... | 40/702 |
| 3,166,186 A | 1/1965 | Karn | ..... | 428/42.3 |

(List continued on next page.)

FOREIGN PATENT DOCUMENTS

| | | | | |
|---|---|---|---|---|
| CA | 1274979 | 10/1990 | ..... | G09F/3/04 |
| DE | 4107469 | 9/1992 | ..... | B65D/73/00 |
| EP | 0613792 | 9/1994 | ..... | B42D/5/02 |
| FR | 2691675 | 12/1993 | ..... | B42D/15/10 |
| GB | 2209993 | 6/1989 | ..... | B32B/7/06 |
| JP | 58 025 379 | 2/1983 | ..... | C09J/7/02 |
| JP | 1214485 | 8/1989 | ..... | B42D/15/02 |
| JP | 1285390 | 11/1989 | ..... | B42D/15/02 |
| JP | 2121896 | 5/1990 | ..... | B42D/15/04 |
| WO | WO 90/11194 | 10/1990 | ..... | B42D/15/02 |
| WO | 92/05036 | 2/1992 | ..... | B42D/15/00 |

*Primary Examiner*—A. L. Wellington
*Assistant Examiner*—Mark T. Henderson
(74) *Attorney, Agent, or Firm*—Thompson Coburn LLP

(57) ABSTRACT

A form with a well has a form layer with a top and a bottom surface and a perimeter, a die cut through the form layer that defines a portion of said form layer within said die cut, a patch layer having a perimeter and top and bottom surfaces, and an adhesive layer that is repositionable and peelable. The patch layer is adhesively but removably secured to the bottom surface of the form layer such that the die cut and form layer portion are entirely within the perimeter of the patch layer. The form has a well, that is created by removal of the form layer portion from within the die cut. The bottom of the well is the top surface of said adhesive layer and the sides of the well are the edges of said die cut. The adhesive layer has a greater affinity for the patch layer than the form layer portion such that when the form layer portion is removed from the form, the adhesive stays adhered to the patch layer. Articles such as photographs may then be inserted into the well. The patch layer, adhesive layer and photograph are separable from a remainder of said form, and the patch and adhesive can be folded over to encapsulate the photograph within a card, with or without a form layer portion included.

25 Claims, 7 Drawing Sheets

U.S. PATENT DOCUMENTS 3,252,234 A 5/1966 Goodman ..... 40/638
3,420,364 A 1/1969 Kennedy ..... 206/460
3,822,492 A 7/1974 Crawley
3,900,219 A 8/1975 D'Amato et al.
3,914,483 A 10/1975 Stipek, Jr.
3,996,679 A 12/1976 Warneke ..... 40/1.5
4,032,679 A * 6/1977 Aoyagi ..... 428/42.3
4,204,706 A 5/1980 Blum et al.
4,248,919 A 2/1981 Davis ..... 428/40
4,379,573 A 4/1983 Lomeli et al.
4,479,838 A 10/1984 Dunsirn et al. ..... 156/247
4,508,365 A 4/1985 Hawes ..... 281/2
4,523,825 A 6/1985 Norris ..... 354/301
4,544,590 A 10/1985 Egan ..... 428/40
4,664,982 A 5/1987 Genovese et al. ..... 428/447
4,695,077 A 9/1987 Pretre
4,742,954 A 5/1988 Shishido ..... 229/92.8
4,863,772 A 9/1989 Cross ..... 428/40
4,876,131 A 10/1989 Ashby et al.
4,890,862 A 1/1990 Buchholz ..... 283/62
4,910,058 A 3/1990 Jameson ..... 428/42
4,925,716 A 5/1990 Haas ..... 428/41
4,982,894 A 1/1991 Schmidt
5,039,652 A 8/1991 Doll et al. ..... 503/206
5,042,842 A 8/1991 Green et al. ..... 283/101
5,049,443 A 9/1991 Kuszaj et al. ..... 428/332
5,129,682 A 7/1992 Ashby ..... 283/81
5,131,686 A 7/1992 Carlson ..... 283/75
5,172,938 A 12/1992 Schmidt ..... 283/109
5,173,080 A 12/1992 Longtin
5,209,514 A 5/1993 Hebert ..... 283/81
5,219,183 A 6/1993 McKillip ..... 283/62
5,271,787 A 12/1993 Hoffmann et al. ..... 156/268
5,318,326 A 6/1994 Garrison ..... 283/101
5,320,387 A 6/1994 Carlson ..... 283/75
5,328,538 A 7/1994 Garrison ..... 156/249
5,362,106 A 11/1994 Longtin ..... 283/109
5,376,418 A 12/1994 Rogers et al.
5,413,532 A 5/1995 Raby ..... 462/2
5,439,255 A 8/1995 McIntire et al. ..... 283/62
5,462,488 A 10/1995 McKillip ..... 462/26
5,466,013 A 11/1995 Garrison ..... 283/107
5,507,901 A 4/1996 Limina et al.
5,509,693 A 4/1996 Kohls
5,529,345 A 6/1996 Kohls
5,531,482 A 7/1996 Blank
5,534,320 A 7/1996 Raby
5,547,227 A 8/1996 Laurash et al.
5,589,025 A 12/1996 Garrison ..... 156/268
5,595,403 A 1/1997 Garrison
5,632,842 A 5/1997 Oliver et al.
5,637,369 A 6/1997 Stewart
5,660,896 A 8/1997 Normand et al. ..... 428/13
5,662,976 A 9/1997 Popat et al.
5,736,212 A 4/1998 Fischer ..... 428/42.2
5,782,497 A 7/1998 Casagrande
5,837,337 A 11/1998 Schnitzer
5,839,763 A 11/1998 McCannel
5,840,143 A 11/1998 Swanson
5,890,743 A 4/1999 Garrison et al.
5,916,665 A 6/1999 Fischer et al. ..... 428/195
6,190,747 B1 2/2001 Fischer ..... 428/42.2

* cited by examiner

FORM WITH INTEGRATED LABEL OR FOLD-OVER CARD INTERMEDIATE AND PHOTOGRAPH WELL

CROSS-REFERENCES TO RELATED APPLICATIONS

This is a Continuation In Part of application Ser. No. 09/318,353, claiming priority to May 25, 1999.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

1. Field of the Invention

This invention relates to business forms having integrated, removable labels and/or fold-over card intermediates, and having a receptacle for incorporating articles such as photographs into the cards or labels.

2. Introduction

The use of business forms with integrated information-carrying cards and labels has risen greatly in recent years as businesses and consumers realize the inherent convenience and capabilities of these products. One capability is the inclusion of photographs within either a form or card.

The growing use of integrated paper systems has not been entirely consistent with the trend in business to become more ecologically minded. Many businesses now have turned their attention to making sure that their consumer mailings and other advertisements are recyclable once they have served their purpose. Unfortunately, many of the prior art integrated form products do not allow for standard recycling of the waste produced by such forms.

As used herein, and as commonly understood in the industry, integrated form and label systems include those in which part of the form itself may become part of a label, or a card. Such systems may also incorporate articles like photographs into a final product like a card or label or into intermediate steps. Such products have proven very beneficial in recent years in part because they allow for relatively convenient end user processing, like scanning, printing through laser printers, copiers, impact printers and the like.

However, the existing products exhibit numerous limitations overcome by the present invention. For example, the transfer tape, die cut type of integrated label disclosed in U.S. Pat. No. 4,379,573 to Lomeli involves the application of transfer tape to the backside of a form and die cutting the integrated label from the front surface of the form. These types of labels have the advantages of being a relatively thin lamination and allowing rapid mass production of the forms. Yet in use, it can be seen that the top surface of the label is opaque and has adhesive over its entire back surface. And the remainder of the form cannot be recycled because it contains non-recyclable release materials. Many variations have been made on these types of transfer labels, including the types using a multi-layer label stock as opposed to the basic transfer tape, as exemplified by U.S. Pat. No. 5,637,369 to Stewart. Nevertheless, this type of integrated label requires the addition of some type of label stock to the back of the form, a die cut through the front of the form to create the label, and some type of release material in the label stock which is left behind on the form when the label is removed.

Another type of label well known in the industry involves the use of a printable patch releasably adhered to the surface of a form and then peeled off in use to be attached to a substrate. These types of labels are not actually integrated labels because no portion of the form becomes part of the label. Thus, the patch material used for these products is a relatively thick (when compared to a transfer tape or similar liner), opaque, and printable stock usually of 50 to 70 pound weight. The labels have the advantage of being relatively thin—although thicker the transfer type labels described above—but have the significant disadvantages of not having the support of a portion of the more substantial form layer integrated into the label. Also, since the label is really just an opaque piece of paper stock with adhesive on the underside, it does not allow the user to see through any portion of the label to the surface of the underlying form.

Integrated fold-over cards are similar to integrated labels in that they are basically an integrated label with a lamination or patch layer that can be folded in half onto itself to enclose or laminate a card created from a portion of the form layer. The relevant prior art integrated card articles, however, exhibit many of the same problems as the integrated label articles. Namely, they require the use of a release liner which remains on the form layer after removal of the card which prevents recycling of the form. For example, the integrated encapsulated card articles disclosed in U.S. Pat. No. 5,662,976 to Popat and U.S. Pat. No. 5,318,326 to Garrison use a lamination layer and a lamination patch, respectively. Both teach and require the use of a release agent which remains on the form after removal of the card, thus preventing the recycling of the form. In addition, the articles taught by both patents necessitate the die cutting of the lamination or patch layer—usually a thin polyester or plastic material—which leaves behind some of this material upon removal of the card from the form, again hampering the recycleability of the form. Finally, the requirement for die cutting through the lamination layer of the prior art fold-over cards significantly increases the cost and complexity to manufacture these articles since extremely accurate dies with limited life spans must be used.

Another useful capability of such paper form and card systems is the ability to incorporate articles such as photographs into the form, label or card at both intermediate steps and in the final end use. Many users find it useful to scan forms, or file them, after adding information to it, which may include not only printed information, but handwritten information and photographs. For example, the sponsor of a conference would find it useful to incorporate into a form a photograph of a conference participant, scan the form to retain an electronic memory of it, file the form hard copy until the conference, and finally issue it to the conference attendee, who may wish to sign it and then remove an id card and/or the photograph from the form and use a patch layer to make an integrated or fold over label or card to use at the conference. For scanners as well as printers, the thickness of the form can present problems with peeling or jamming.

It is to address these problems and otherwise accommodate uses desired by consumers that the present invention was developed.

BRIEF SUMMARY OF THE INVENTION

The present invention provides a thin recyclable business form with an integrated label and/or card intermediate which is relatively quick and inexpensive to mass produce and convenient to employ by the end user. This is accomplished by the fact that once the label and card intermediate are removed from the business form, the form is devoid of silicone or other release materials and is therefore completely recyclable. Moreover, when glassine—a crushed, transparent paper product—is used for the patch layer of the invention, the label and the card intermediate themselves are also recyclable.

The present invention provides a thin form which is easy to manufacture and store while allowing for visible preprinting of the form, label and card as well as end user laser printing, photocopying or even handwriting thereon. Specifically, the present invention requires that only one laminae be adhered to the form and it does not require the use of release material of any kind whether in liner, layer or coating form. Moreover, the invention does not require die-cutting of the thin plastic lamination layer to construct the articles, rather it requires only die cutting into the form layer. This alone translates directly into higher production speeds for the finished article and approximately five times greater die life on dies that are much less expensive than those required to cut the thin patch material. Also, since the card and label are removable from the front of the form, their use by the consumer is simpler and more intuitive than some of the prior articles which remove from the back of the forms.

The present invention is a business form with an integrated label and/or fold-over card intermediate. The basic form comprises a form layer having top and bottom surfaces and a periphery, at least one die cut through the top and bottom surfaces within the periphery of the form layer which defines at least one portion of the form layer within the die cut, and a patch layer. The patch layer has a periphery and top and bottom surfaces with the bottom surface of the patch layer adhesively but removably secured to the top surface of the form layer over the entire die cut and the entire form layer portion by a layer of repositionable, peelable adhesive. The adhesive layer has a greater affinity for the bottom surface of the patch layer than the top surface of the form layer.

In a first embodiment, the patch layer, adhesive layer and form layer portion comprise a label. As a result of the affinity of the adhesive, when the label is removed from the form, the portion of the adhesive layer that is not between the patch layer and the portion of the form layer is exposed and stays adhered to the bottom surface of the patch layer. Of course, the portion of the adhesive layer which is between the patch layer and the portion of the form layer stays adhered to both the bottom surface of the patch layer and the top surface of the form layer portion upon removal of the label.

Alternatively, in a second embodiment, the patch layer, adhesive layer and form layer portion comprise an integrated fold-over card intermediate. More specifically, the form with integrated fold-over card intermediate comprises a form layer having top and bottom surfaces and a periphery, at least one die cut through the top and bottom surfaces of the form layer within the periphery of the form layer defining at least one portion of the form layer within the die cut, and a patch layer having two halves, a periphery and top and bottom surfaces. The two halves of the patch layer may be divided by a line of perforations to ease the folding of the patch layer to form the completed card.

The bottom surface of the first half of patch layer is secured to the top surface of the form layer over the entire die cut and the entire form layer portion by a repositionable, peelable adhesive layer. The bottom surface of the second half of the patch layer is secured to the top surface of the form layer by the adhesive layer over neither the die cut nor the form layer portion.

As in the label embodiment, the adhesive layer has a greater affinity for the bottom surface of the patch layer than the top surface of the form layer such that when the fold-over card intermediate is removed from the form layer, the portion of the adhesive layer that is not between the patch layer and the form layer portion is exposed and stays adhered to the bottom surface of the patch layer. Once removed from the form layer, the fold-over card intermediate can be folded in half, thus securing the two halves of the patch layer together by the adhesive layer and enclosing the form layer portion between the folded halves of the patch layer.

The present invention also accommodates insertion of articles within the form, label or card at intermediate steps in the use of the paper form system. The present invention allows for a portion of the form within a dye cut, or a subsection of it, to be removed, thereby exposing a shallow well at the bottom of which the patch layer's adhesive is exposed. Into this well may be placed and adhered an outside article, such as a barcode card, a hologram, momento or, most commonly, a photograph. Creating such a well and filling it with an article such as a photograph allows for the top surface of the inserted photograph to be approximately even with the top surface of the form circumscribing it. Accordingly, the form and patch assembly with the photograph inserted in the well may be smoothly run through roller type scanners and through printers. After saving an electronic version of the form with the inserted photograph, the even surface of the combination allows for easy filing of the hard copy for either temporary or permanent storage. When the time comes for the final use, the photograph may be pushed through the well, either alone or along with a portion of the form layer within the dye cut A matching complimentary second portion of the form layer may be included, or not. The patch layer, once removed from the form, may be made into a label or card with the article or photograph from the well and/or with form layer portions. As before, the fold over patch is folded over to encapsulate a form layer portion with a photograph, a photograph alone, or a photograph back-to-back with the matching form layer portion. In any case, the form, as above, may be refiled for storage without any obtrusive adhesive remaining on it.

Further features and advantages of the present invention, as well as the structure and operation of various embodiments of the present invention, are described in detail below with reference to the accompanying drawings.

DETAILED DESCRIPTION OF THE INVENTION

References to layers in this specifications include sheets, webs, strips, and all other appropriate forms of laminae common in the industry. Similarly, as used herein, printing and printed indicia are meant to include all known methods of application of printed indicia to a substrate including photocopying, laser printing, impact, pre-printing, and handwriting.

Figure 1:
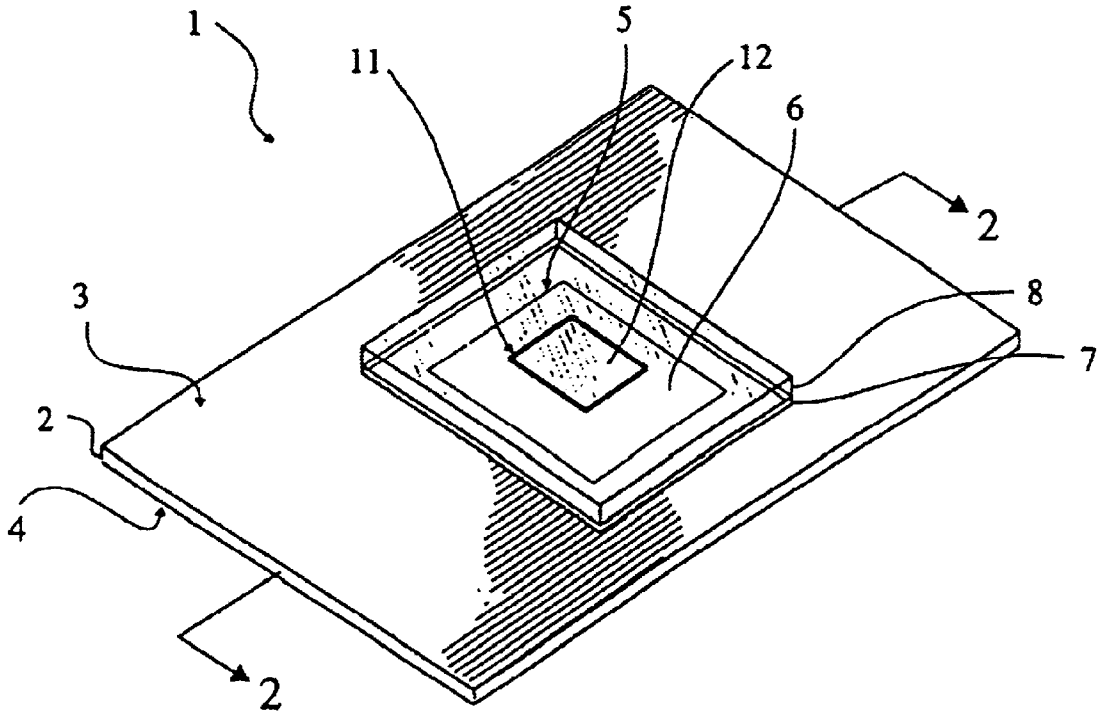
FIG. 1 is a perspective view of the form with integrated label.

Turning now to the figures, in FIG. 1, there is shown a perspective view of the form with integrated label shown generally as 1. The form 1 comprises a form layer 2, an adhesive layer 7 and a patch layer 8.

The form layer 2 may consist of any applicable business form, preferably one that has been preprinted on its top and/or bottom surfaces, 3 and 4 respectively. Although the form layer 2 can be any stock of suitable weight and thickness, in the preferred embodiment, the form layer 2 is paper stock of 20 lbs. to 100 lbs. weight and two thousandths of an inch to eight mils thickness. By using such weights and thickness', the form layer 2 is recyclable yet the form 1 is sized sufficiently for use in commercially available laser printers.

Figure 2:
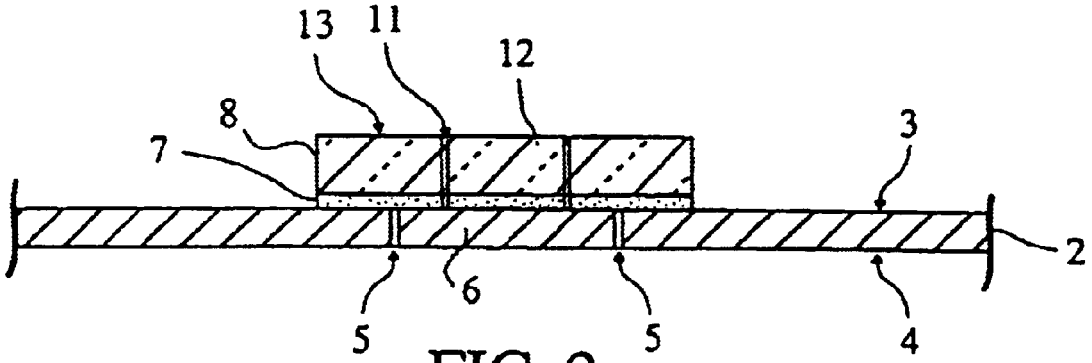
FIG. 2 is a cross-section view of the embodiment as shown in FIG. 1.

As shown best in FIG. 2, the form layer 2 contains therein at least one die cut 5 through the form layer 2 defining at least one portion 6 of the form layer 2 within the die cut 5. A layer of adhesive 7 and a patch layer 8 are layered over the die cut 5 and form layer portion 6.

The adhesive layer 7 is a repositionable and peelable adhesive with a greater affinity for the bottom surface 9 of the patch layer 8 then for the top surface 3 of the form layer 2. As a result and as shown generally in FIG. 3, when the patch layer 8 is peeled from the top surface 3 of the form layer 2, the adhesive layer 7 adheres to the bottom surface 9 of the patch layer 8 rather than the top surface 3 of the form layer 2.

Of course, since the form layer portion 6 is physically separated from the rest of the form layer 2 by the die cut 5, when the patch layer 8 is peeled from the form layer 2, the form layer portion 6 remains adhered to the patch layer 8. Thus, the patch layer 8 with the adhesive layer 7 and the form layer portion 6 comprise the integrated label 10. Once the label 10 is removed from the form layer 2, the label 10 can be adhered to the surface of another substrate by the exposed areas of the adhesive layer 7.

The patch layer 8 is usually a thin and substantially transparent or at least translucent material. In the preferred embodiment, the patch layer 8 is composed of a clear crushed paper glassine material, however, other clear films including polyester or other papers, could be used as well. The translucent characteristic of the patch layer 8 is important since if printed information is placed on the top surface 3 of the form layer 2, and more specifically, if the indicia are placed on the top surface 3 of the form layer portion 6, the end user will be able to see the printed indicia through the translucent patch layer 8. In addition, the top surface 13 of the patch layer 8 may be made compatible with available printing methods so that additional printing could be placed thereon, for example, by running the completed form 1 through a laser printer or by the end user handwriting information thereon before or after removal of the label 10 from the form 1.

For clarity, only one die cut 5 and one form layer portion 6 have been shown under the patch layer 8 in the drawings. It should be understood, however, that a single label 10 may be comprised of more than one form layer portion 6. For example, a manufacturer may want to use the form 1 as an invitation complete with an integrated identification tag for an event it is sponsoring. The manufacturer could pre-print the top surface 3 of the form layer 2 with various information regarding the event, including its logo, general instructions regarding filling out the identification tag, and the logo for the event itself. The patch 8 would then be laminated onto the top surface 3 of the form layer 2 over some of that information. To avoid having the general instructions become part of the label 10 (the identification tag), at least two die cuts 5 would be made from the bottom surface 4 of the form layer 2 around the manufacturer's and the event's logos. Thus, the pre-printed logos would become part of the label 10 when it is removed from the form 1 while the general instructions would remain on the form layer 2.

Figure 3:
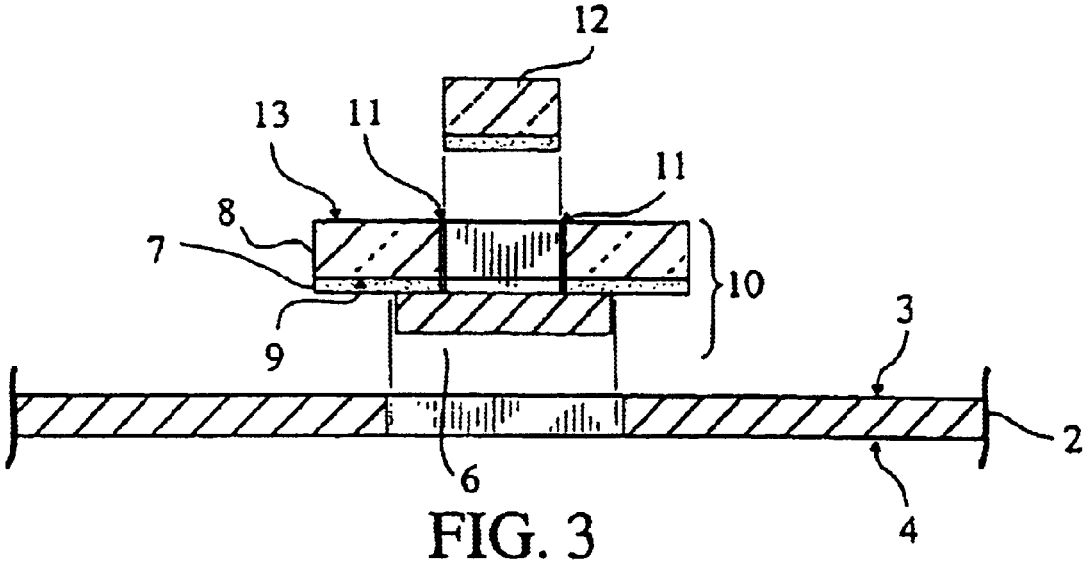
FIG. 3 is a cross-sectional view of the form with integrated label showing the removal of the label from the form.

Another variation to the basic embodiment is shown in FIGS. 1, 2 and 3, as a bullet label 12 within the label 10. The bullet label 12 comprises a portion of the patch layer 2 defined by a die cut 11 extending through the patch layer 8 and adhesive layer 7. Thus, the bullet label 12, can be removed from the label 10 as shown in FIG. 3 and attached to another substrate.

Figure 4:
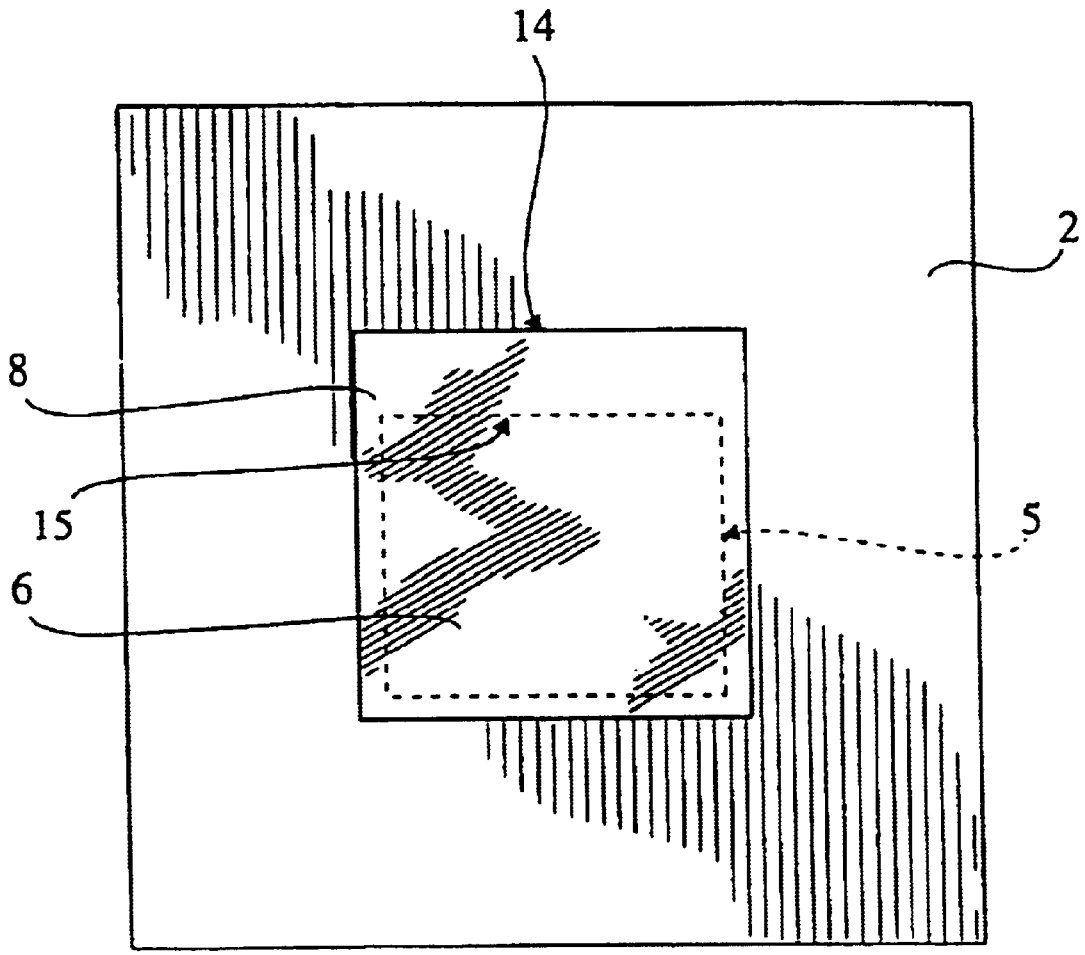
FIG. 4 is a front view of an alternate embodiment of the invention shown in FIG. 1.

FIG. 4 shows a top view of another variation of the present invention. In this embodiment the patch layer 8 is composed of an opaque material. Also, the patch layer 8 and the die cut 5 are sized and oriented with respect to each other such that the distance between an edge 14 of the patch layer 8 and a corresponding edge 15 of the form layer portion 6 is greater than that distance between the other corresponding edges. In this way, when the label is removed from the form 1, adhesive layer 7 exposed on the bottom side 9 of the patch layer 8 is wider along one edge 14 of the patch layer 8 than along the other edges. Thus, the label 10 could serve as a note or reminder label which could be adhered to a substrate principally by the wider edge of exposed adhesive layer 7.

This embodiment directly addresses a problem with mass production of existing products. Prior notes of somewhat similar design have been difficult to use in large volume applications. This is due to the small area of adhesive and the fact that the note is usually precut and applied to the form during processing. This is a difficult process in mass production and one which results in a form that may not withstand the rigors of the manufacturing and printing environments before the note prematurely releases from the form. The present invention prevents premature removal of the note because there is sufficient adhesive around even the three narrow edges of the patch layer 8 to hold the patch layer 8 to the form layer 2 during manufacturing and printing processes. Thus, the label 10 releases from the form layer 2 only when pulled off by the end user. This arrangement holds the label 10 in the form 1 for processing while allowing easy attachment to and repositioning of the label 10 on a substrate by the wide edge of exposed adhesive 7 when the label 10 is removed.

In a somewhat similar variation, the patch layer 8 can be sized and offset in relation to the die-cut 5 in the form layer 2 such that the distance between an edge of the patch layer 2 and a corresponding edge of the form layer portion 6 is less than that between the other corresponding edges. In this way, the width of the adhesive along one edge of the label 10 is minimized. This minimizes the bond between the label 10 and the form layer 2 along this edge and provides for easier removal of the label 10 from the form 1 by the end user while ensuring sufficient bond to prevent premature release during processing or printing.

Figure 9:
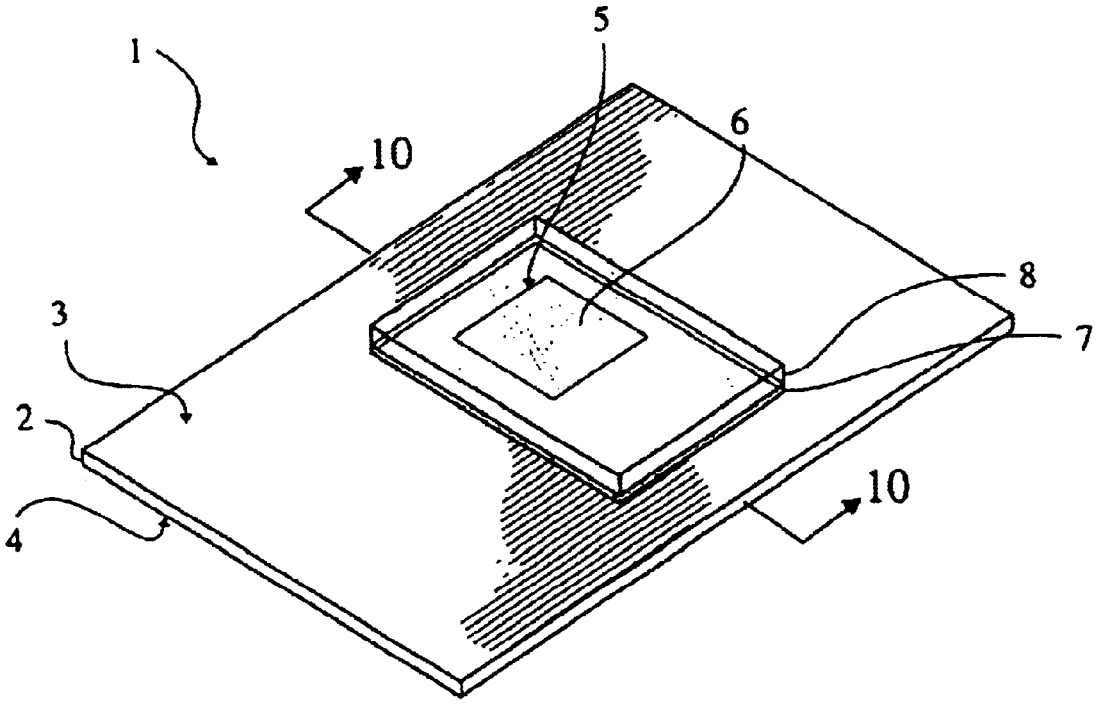
FIG. 9 is a perspective view of another embodiment of the form with fold-over card intermediate.
Figure 10:
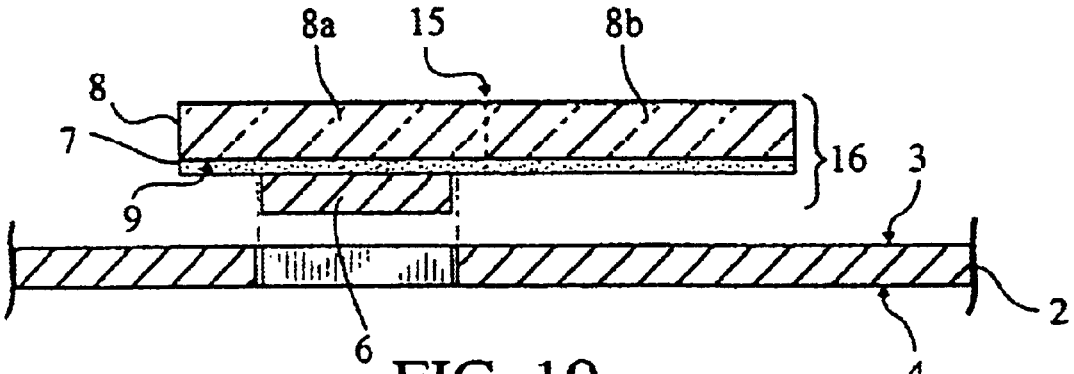
FIG. 10 is a cross-sectional view of the embodiment shown in FIG. 9.

FIGS. 9 and 10 show an alternate embodiment of the present invention, a form 1 with integrated fold-over card intermediate, shown generally as 16 in FIG. 10. In this embodiment, the invention comprises a form layer 2 having top 3 and bottom 4 surfaces. The form layer 2 contains at least one die cut 5 through the form layer 2 defining at least one portion 6 of the form layer 2 within the die cut 5. FIG. 10 shows the bottom surface 9 of one half 8*a* of the patch layer 8 secured by a repositionable, peelable adhesive layer 7 to the top surface 3 of the form layer 2 over the entire die cut 5 and the entire form layer portion 6 of the form layer 2. The second half 8*b* of the patch layer 8 is a mirror image of the first half 8*a* of the patch layer 8. The bottom 9 surface of the second half 8*b* of the patch layer 8 is also secured to the top surface 3 of the form layer 2 by the adhesive layer 7, however, the second half 8*b* of the patch layer 8 is not positioned over the die cut 5 or the form layer portion 6.

So arranged, the patch layer 8, adhesive layer 7 and the form portion 6 comprise the fold-over card intermediate 16. As in the previous embodiments, the adhesive layer 7 has a greater affinity for the bottom 9 surface of the patch layer 8 than the top 3 surface of the form layer 2. Thus, when the fold-over card intermediate 16 is removed from the form layer 2 by peeling back an edge of the patch layer 8, the portion of the adhesive layer 7 that is not between the patch layer 8 and the form portion 6 is exposed and stays adhered to the bottom 9 surface of the patch layer 8.

Figure 11:
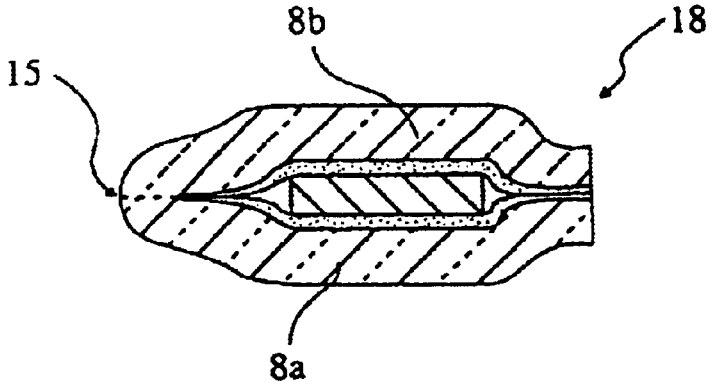
FIG. 11 is a cross-sectional view of an alternate embodiment folded-over card.

Once removed from the form layer 2, the fold-over card intermediate 16 can be folded in half thus securing the two halves 8*a,* 8*b* of the patch layer 8 together by the adhesive layer 7 and enclosing the form layer portion 6 between the two folded halves 8*a,* 8*b* of the patch layer 8 as shown in FIG. 11. Although the adhesive layer 7 is repositionable and peelable from certain substrates like the form layer 2, when adhered to itself as in the completed card, generally shown in FIG. 11 as 18, the adhesive layer 7 forms a substantially permanent bond between the halves 8*a,* 8*b* of the patch layer 8.

This substantially permanent bond also yields a tamper evident feature to the fold-over card invention. If the halves 8*a* and 8*b* of the patch layer 8 are forced apart once adhered to each other, some of the adhesive layer 7 will pull away from the side of the patch layer 8 it was originally on. This results in a mottled look to the adhesive layer 7 due to the offsetting of some of the adhesive which is visible through the patch layer 8 when the halves 8*a* and 8*b* are reunited. This mottled look is easily distinguishable from the substantially clear look of the initial adhesive to adhesive bond and a tell-tale sign of attempted tampering with information contained in the fold-over card 16.

The embodiment of the invention having a fold-over card intermediate 16 containing a single card portion 6 carries the benefit of allowing both sides of the card portion 6 to be viewed through the patch layer 8 when the fold-over card intermediate 16 is folded in half into the finished card 18. In other words, a printed indicia on both sides of the card portion 6 can be viewed through the halves of the translucent patch layer 8.

This has an added benefit when the fold-over card intermediate 16 is used as an identification card or requires a signature by the end user. In such a use, the end user who receives the form containing the fold-over card intermediate 16 can sign the back 4 of the form in the form portion 6 and then remove the fold-over card intermediate 16 and fold it in half, this prevents tampering with the user's signature which is now fully enclosed by the patch layer 8.

Figure 8:
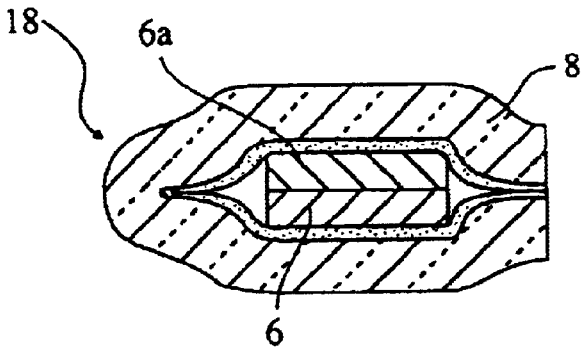
FIG. 8 is a cross-section of an embodiment of the folded-over card.

In some instances, however, it may be beneficial to have the additional thickness and strength of a card intermediate having two form layer portions. Such an embodiment is shown in FIGS. 5 through 8. In this embodiment, at least one second die cut 5*a* is made in the form layer 2 defining at least one second portion 6*a* of the form layer 2. The second die cut 5*a* and second form layer portion 6*a* are disposed beneath the second half 8*b* of the patch layer such that the second form layer portion 6*a* is removably secured to the bottom 4 surface of the second half 8*b* of the patch layer 8 by the adhesive layer 7 and becomes part of the fold-over card intermediate 16. Thus, upon removal of the intermediate 16 from the form layer 2, the second form layer portion 6*a* is enclosed with the first form portion 6 when the intermediate 16 is folded in half. As can be seen in FIG. 8, when folded in half, only the top surfaces 3 of the first and second form layer portions 6 and 6*a,* respectively, are visible through the patch layers 8 because the bottom 4 surfaces of the form layer portions 6 and 6*a* are laminated together and obscured from sight.

As will be understood by those in the industry, it is beneficial that the present invention provides for the viewing of the top surfaces 3 of the form layer portion 6 and 6*a* (if used) through the patch layer 8 of the card intermediate 16. Usually, business forms have a larger number and quantity of printed colors on the front of the forms than the back. Since most printing presses have a limited capability for printing different colors, it can be difficult to obtain the necessary colors on the backside of the form. For example, when processing a form though a press that prints six colors, the form may require five colors on the front which leaves only one for the backside. This is a significant limitation of prior articles which form the exposed areas of the card from the back of the business form.

Also, in either the single or multiple form layer portion embodiments, the patch layer can contain a line of perforations 15 separating the halves, 8*a* and 8*b,* of the patch layer 8. When the card intermediate 16 is removed from the form 1, the intermediate 16 can be folded in half along the line of perforations 15. And like the label embodiment previously described, for clarity, only one die cut 5 and one form layer portion 6 have been shown under each half of the patch layer 8 in the drawings. It should be understood, however, that a single card intermediate 16 may be comprised of more than one form layer portion 6 under each half of the patch layer 8.

Figure 12:
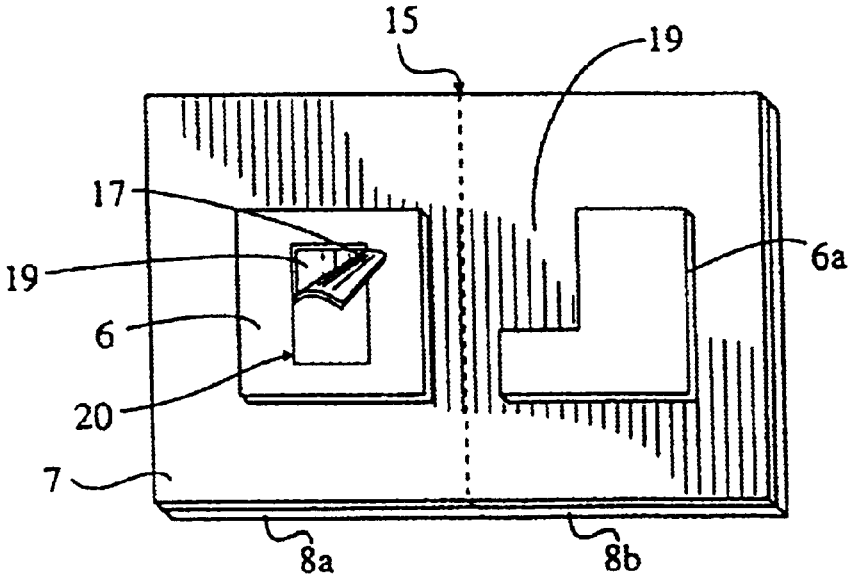
FIG. 12 is a bottom side view of the card intermediate showing the removable sections for viewing articles placed in the card intermediate.

A final embodiment of the fold-over card article is shown in FIG. 12 and has at least one area 19 of exposed adhesive 7 incorporated into the card intermediate 16 for viewing an article placed into the intermediate 16. A preferred method of creating this area 19 is a die cut 20 in the card portions 6 or 6*a* which creates a waste section 17 within the card portions 6 or 6*a* or along at least one edge of the card portions 6 or 6*a*. This waste section 17 can be peeled from the card intermediate 16 which leaves the adhesive layer 7 on the bottom surface of the patch layer 8 because of the affinity characteristics of the adhesive. Although the waste portion 17 is separated from the rest of the form layer 2 and the card layer portions 6 and 6*a,* by the die cut 20, it is sufficiently secured to the card intermediate 16 by the adhesive layer 7 for transport though the assembly and printing processes.

Alternatively, when the waste section 17 is along at least one edge of the form layer portion 6, the area 19 can be defined by shaping the same die cut 5 that defined the form layer portion 6. In this way, waste section 17 can be made to be part of the form layer 2 and remain behind when the card intermediate 16 is removed from the form 1.

However defined, the area 19 of exposed adhesive 7 is created by removing the waste section 17 and exposing the adhesive layer 7 thereunder. An article—a picture, magnetic key, microchip, momento, etc.—can then be placed into or over the area 19. Thereafter, the card intermediate 16 is folded in half enclosing the article in the finished card 18. The area 19 can be in one or both of the card layer portions 6 or 6*a* and can be located within one of the card layer portions 6 or 6*a* or along one or more edges of the card layer portions as shown in FIG. 12. Also, the area 19 need not be larger than the article and the article need not be placed into the area, but the area must be large enough to view the relevant portion of the article through the patch layer 8. For example, if a picture is used as the article, it could be larger than the area 19 and simply placed over the area 19 such that the relevant portion of the picture is viewable through the area 19 while the rest of the picture is obscured by the form layer portion 6.

All the embodiments disclosed herein are created using the same basic method. First, printing, if necessary, is placed on the top surface 3 of the form layer 2. Then, a roll of patch layer material having the adhesive layer 7 already disposed on the bottom side 9 thereof, is unwound. The patch layer material in the roll is already cut to the appropriate width for use. Also, when used to construct the form with integrated card intermediate embodiment, the patch material roll may have been pre-perforated along the line 15. As an alternative to the roll of patch layer material, the patch layer material and the patch layers 8 could be prepared as pre-cut labels, as is known in the art. In any event, the patch layer material is cut into individual patch layers 8 by known methods. The patch layers 8 are applied to the top surfaces of the form layer 2 by the adhesive 7 also using known methods.

Depending on the embodiment sought and the predetermined size and arrangement of the patch layer 8 with respect to the form layer 2, the necessary die cuts 5, 5*a* and 20, are made in the form layer 2 from the back side 4 of the form layer 2. The die cut 11, for the bullet label 12, if used, can also be made at this time through the top surface 13 of the patch layer 8. Printing can also be placed on the top surface 13 of the patch layer 8, by the manufacturer of the form 1 or by the end user.

As can be seen, die cuts in the patch layer 8 are not required to form the integrated label 10 or the card intermediate 16. This greatly enhances the speed and ease of manufacturing the invention.

Figure 5:
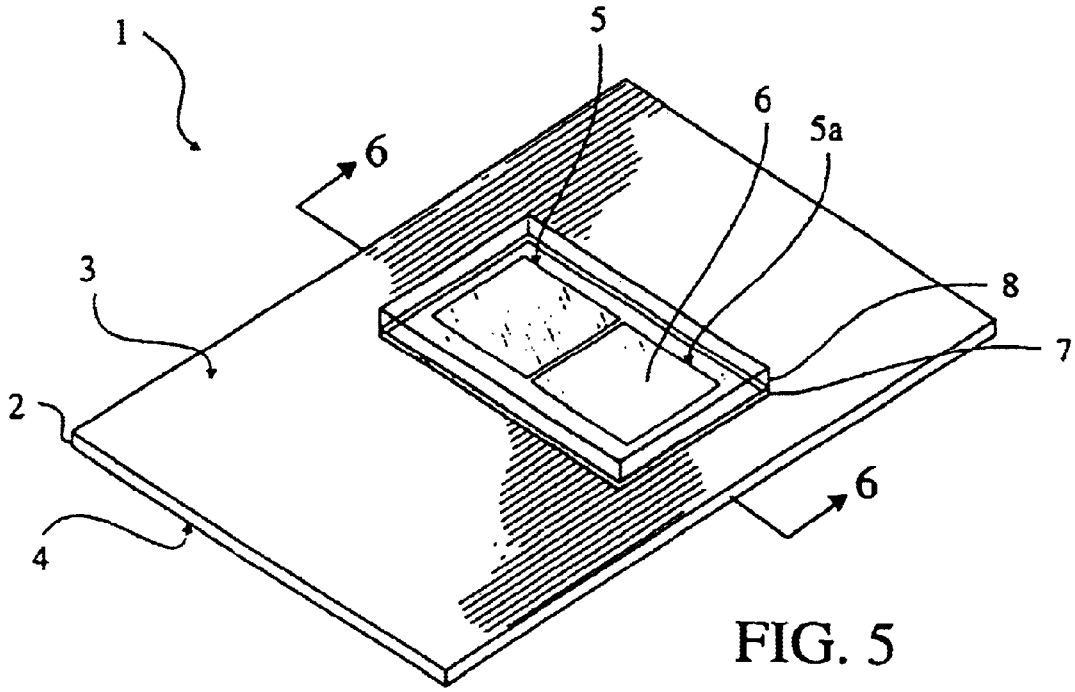
FIG. 5 is a perspective view of the form with integrated fold-over card intermediate.
Figure 6:
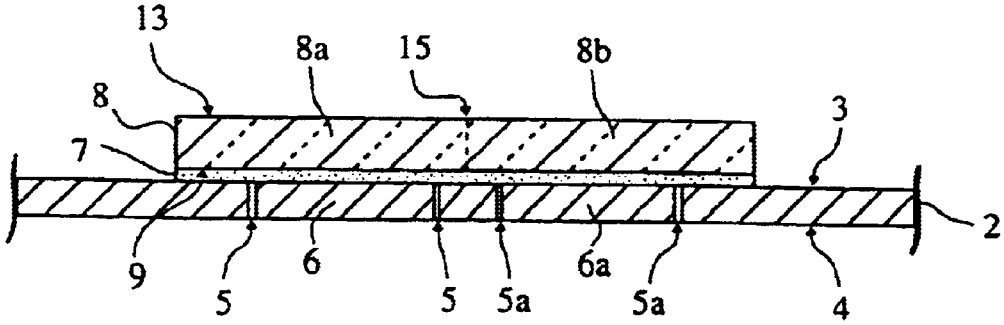
FIG. 6 is a cross-sectional view of the embodiment shown in FIG. 5.
Figure 7:
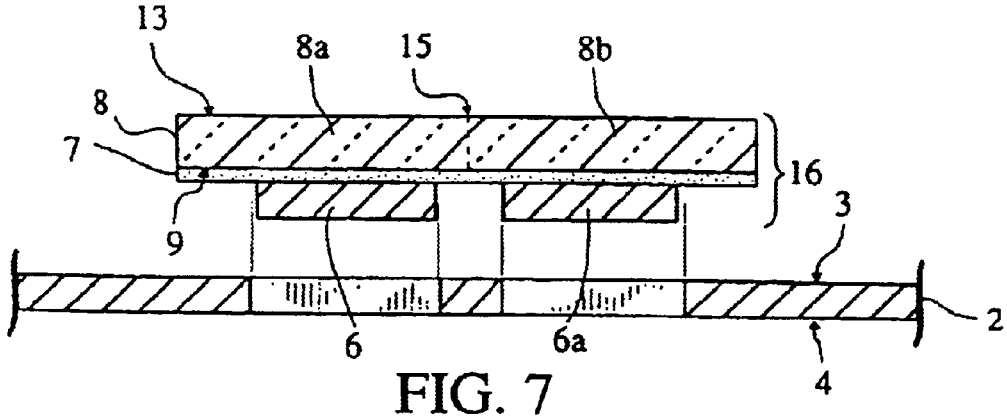
FIG. 7 is a cross-section view of the form with integrated fold-over card intermediate showing the removal of the intermediate from the form.
Figure 13:
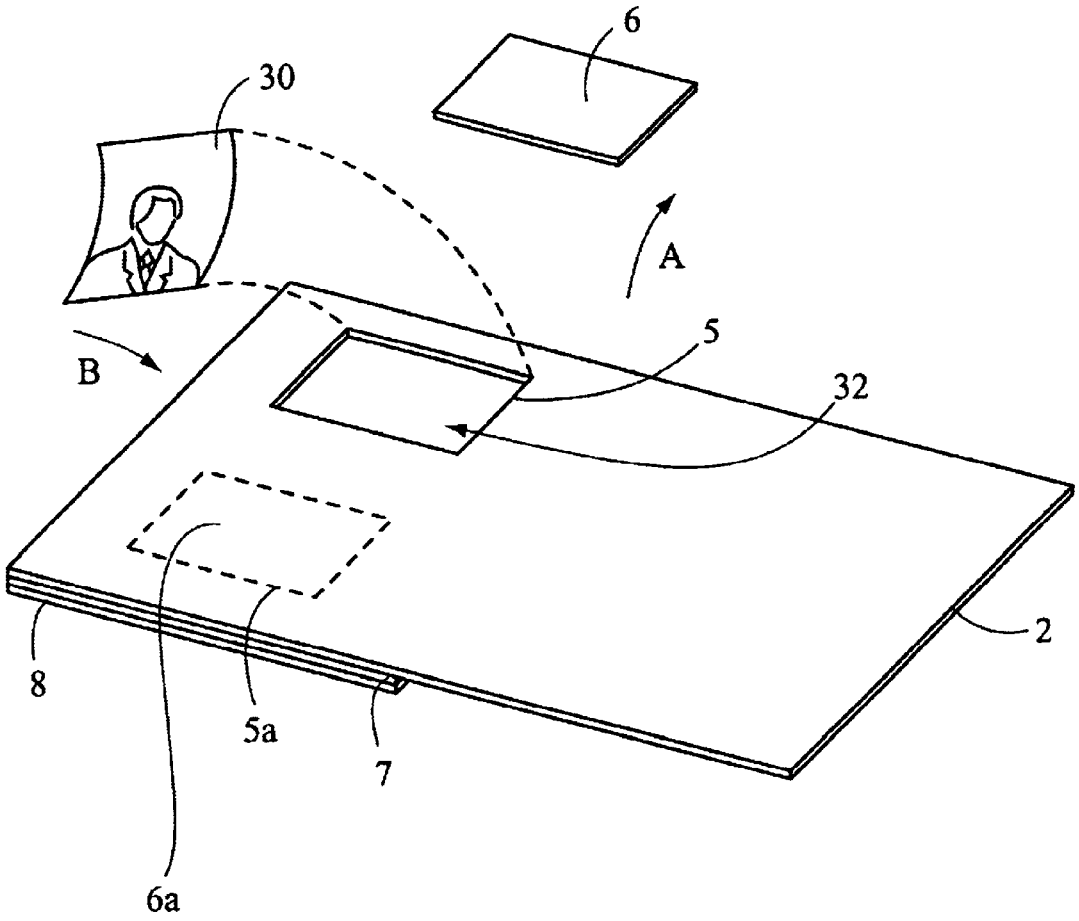
FIG. 13 is a perspective view of the form and patch assembly depicting the method of insertion of a photograph.

FIG. 13 depicts the form and patch assembly of the present invention being used for the method of encapsulating an article, in this case, a photograph. As before, form layer, 2, is backed by adhesive layer, 7 and patch layer 8, in the same manner as depicted in FIG. 5. FIG. 13 shows this assembly viewed from the opposite side of form layer 2 as that depicted in FIG. 5.

A die cut, 5, extends through form layer 2 but not through adhesive layer, 7, or patch layer 8. Optionally, a second die cut, 5A, may be made as an alternative embodiment.

As above, die cut, 5, creates a portion of the form layer, 6, which, being separated from the rest of the form layer by the die cut, is held in place only by its adhesive union with adhesive layer 7. In FIG. 13, the form layer portion, 6, is depicted as having been removed by a user by peeling it away from the adhesive layer, 7 in the direction indicated by arrow A.

The removal of form layer portion, 6, creates a well, 32. The well floor is comprised of the surface of adhesive layer, 7 facing the form layer, 2. The walls of the shallow well are comprised of the edges of the form layer, 2, created by die cut, 5. The well is therefor as deep as the form layer 2 is thick. This thickness will approximate the thickness of any article which may be placed in well 32. Of course, it is considered to be within the scope of this invention that articles placed in well, 32, may be of thicknesses that vary from the thickness of form layer, 2. Additionally, the size of any article placed in well, 32, may correspond to the dimensions of the die cut, 5, or be larger or smaller than the well, 32.

The article, 30, in this case a photograph, is placed in the well according to the method of the present invention. Photograph, 30, is inserted into the well in the direction indicated by arrow B. It will be recalled that adhesive layer 7 and patch layer 8 are substantially transparent, and so the photograph, 30, may be seen through them. Once photograph, 30, or another article, is placed in well, 32, the entire assembly including form layer, 2, patch and adhesive layer, 7 and 8, and the inserted article or photograph, 30, are substantially flat enough to be run through a scanner or printer without jamming or peeling. Hence an intermediate form including an added photograph has been created. This form is scannable and printable in the sense that it will proceed through scanners and printers without jamming or peeling. It should be further noted that the assembly of the form, adhesive and patch layers with the inserted article still has no exposed area of adhesive, and no adhesive remainder which eases filing of hard copies adjacent to one another. Finally, the removed form layer portion, 6, is also free of adhesive and so may be recycled.

Once the article or photograph has been placed in the well, 32, the assembly is ready for creation of a fold-over card or patch. Patch and adhesive layers, 8 and 7, are removed from form layer, 2, along with the inserted photograph, 30. This may be achieved, alternatively and equivalently, by peeling the patch and adhesive layers back from form layer, 2, by pushing the photograph, 30, through the hole in form layer, 2, created by die cut, 5, or a combination thereof. Once removed, the patch, adhesive and photograph assembly may be folded over such that the photograph, 30, is encapsulated between two halves of the patch layer, 8, which are adhered together by adhesive layer, 7, as depicted in FIG. 11.

If the optional second die cut, 5A has been made in order to create optional second form layer portion, 6A, this form layer may be also be pushed through the well and peeled away with the patch and adhesive layers, 8 and 7, in order to create an intermediate assembly including both form layer portion 6A and inserted photograph, 30 (or other article) on top of adhesive layer 7. Thereafter, the two halves of the patch layer, 8, may again be folded over to encapsulate both the photograph, 30, and form layer portion, 6A, in order to create an encapsulated final card or label such as that depicted in FIG. 8.

In view of the foregoing, it will be seen that the several advantages of the invention are achieved and attained.

The embodiments were chosen and described in order to best explain the principles of the invention and its practical application to thereby enable others skilled in the art to best utilize the invention and various embodiments and with various modifications as are suited to the particular use contemplated.

As various modifications could be made in the constructions and method herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A printable form comprising:

a patch layer having opposite top and bottom surfaces and a perimeter edge extending around the patch layer;

an adhesive layer having opposite top and bottom surfaces and a perimeter edge extending around the adhesive layer, the adhesive layer top surface being secured to the patch layer bottom surface;

a form layer having opposite top and bottom surfaces and a perimeter edge extending around the form layer, the form layer top surface being removably secured to the adhesive layer bottom surface whereby the patch layer is removably secured to the form layer;

at least one die cut through the form layer bottom surface and the form layer top surface within the perimeter edges of the patch layer and the adhesive layer, the one die cut defining one form layer portion within the die cut that is removably secured to the adhesive layer bottom surface;

the adhesive layer having a greater affinity for the patch layer bottom surface than the form layer top surface whereby the one form layer portion can be removed from the form layer creating a well within the die cut with a portion of the adhesive layer bottom surface exposed in the well;

a second die cut through the form layer bottom surface and the form layer top surface within the perimeter edges of the patch layer and the adhesive layer, the second die cut defining a second form layer portion within the second die cut that is removably secured to the adhesive layer bottom surface; and, a fold line extending across the patch layer and the one die cut and the second die cut being symmetrically positioned on opposite sides of the fold line.

2. The form of claim 1, further comprising:

the perimeter edges of the patch layer and he adhesive layer being spaced inwardly from the perimeter edge of the form layer.

3. The form of claim 1, further comprising:

the perimeter edges of the patch layer and adhesive layer coinciding.

4. The form of claim 1, further comprising:

the patch layer and adhesive layer being removable from the form layer top surface with the one form layer portion attached to the adhesive layer bottom surface.

5. The form of claim 1, further comprising:

the top surface of the patch layer and the top surface of the form layer being adapted to accept printed indicia.

6. The form of claim 1, further comprising:

the patch layer being transparent.

7. The form of claim 3, further comprising:

the perimeter edges of the patch layer and adhesive layer being spaced outwardly from the one die cut.

8. The form of claim 4, further comprising:

the patch layer having an area that is at least twice as large as an area of the one form layer portion.

9. The form of claim 5, further comprising:

the bottom surface of the form layer being adapted to accept printed indicia.

10. A printable form comprising:

a patch layer having opposite top and bottom surfaces and a perimeter edge extending around the patch layer;

an adhesive layer having opposite top and bottom surfaces and a perimeter edge extending around the adhesive layer, the adhesive layer top surface being secured to the patch layer bottom surface;

a form layer having opposite top and bottom surfaces and a perimeter edge extending around the form layer, the form layer top surface being removably secured to the adhesive layer bottom surface whereby the patch layer is removably secured to the form layer;

at least one die cut through the form layer bottom surface and the form layer top surface within the perimeter edges of the patch layer and the adhesive layer, the one die cut defining one form layer portion within the die cut that is removably secured to the adhesive layer bottom layer surface;

the adhesive layer having a greater affinity for the patch layer bottom surface than the form layer top surface whereby the one form layer portion can be removed from the form layer creating a well within the die cut with a portion of the adhesive layer bottom surface exposed in the well; and, the well being dimensioned to enable insertion of a separate article into the well and against the portion of the adhesive layer bottom surface exposed in the well to removably secure the article in the well.

11. The form of claim 10, further comprising:

a fold line extending across the patch layer and the one form layer portion being positioned entirely to one side of the fold line.

12. The form of claim 10, further comprising:

a second die cut through the form layer bottom surface and the form layer top surface, the second die cut surrounding the first die cut.

13. The form of claim 10, further comprising:

the article being a photograph.

14. The form of claim 10, further comprising:

a fold line extending across the patch layer and the one form layer portion being positioned entirely to one side of the fold line.

15. A printable form comprising:

a patch layer having opposite top and bottom surfaces and a perimeter edge extending around the patch layer;

an adhesive layer having opposite top and bottom surfaces and a perimeter edge extending around the adhesive layer, the adhesive layer top surface being secured to the patch layer bottom surface;

a form layer having opposite and top and bottom surfaces and a perimeter edge extending around the form layer, the form layer top surface being removably secured to the adhesive layer bottom surface whereby the patch layer is removably secured to the form layer;

at least one die cut through the form layer bottom surface and the form layer top surface within the perimeter edges of the patch layer and the adhesive layer, the one die cut defining one form layer portion within the die cut that is removably secured to the adhesive layer bottom surface;

the adhesive layer having a greater affinity for the patch layer bottom surface than the form layer top surface whereby the patch layer and adhesive layer can be removed from the form layer top surface with the one form layer portion beinci removed from the form layer and attached to the adhesive layer bottom surface;

a second die cut through the form layer bottom surface and the form layer top surface within the perimeter edges of the patch layer and the adhesive layer, the second die cut defining a second form layer portion within the second die cut that is removably secured to the adhesive layer bottom surface; and, a fold line extending across the patch layer and the one form layer portion and the second form layer portion being symmetrically positioned on opposite sides of the fold line.

16. The form of claim 15, further comprising:

the fold line dividing the patch layer into two equal area sections.

17. The form of claim 15, further comprising:

the fold line being a line of perforations.

18. The form of claim 15, further comprising:

the perimeter edges of the patch layer and the adhesive layer coinciding.

19. The form of claim 15, further comprising:

the perimeter edges of the patch layer and the adhesive layer being spaced outwardly from the one die cut.

20. The form of claim 15, further comprising:

the patch layer having an area that is at least twice as large as an area of the one form layer portion.

21. The form of claim 15, further comprising:

the patch layer being transparent.

22. The form of claim 15, further comprising:

the perimeter edges of the patch layer and the adhesive layer being spaced inwardly from the perimeter edge of the form layer.

23. The form of claim 15, further comprising:

the top surface of the patch layer and the top surface of the form layer being adapted to accept printed indicia.

24. The form of claim 15, further comprising:

the one form layer portion and the second form layer portion having equivalent areas.

25. The form of claim 23, further comprising:

the bottom surface of the form layer being adapted to accept printed indicia.

* * * * *